United States Patent [19]

Thigpen

[11] 4,453,600

[45] Jun. 12, 1984

[54] SIGNAL SHANK PARALLEL RIPPER APPARATUS

[76] Inventor: James L. Thigpen, P.O. Box 1786, Cleveland, Tex. 77327

[21] Appl. No.: 404,402

[22] Filed: Aug. 2, 1982

[51] Int. Cl.[3] ..... A01B 13/08

[52] U.S. Cl. ..... 172/250; 172/483; 172/464

[58] Field of Search ..... 172/464, 474, 484, 491, 172/481, 691, 307, 699, 483

[56] References Cited

U.S. PATENT DOCUMENTS

| | | | |
|---|---|---|---|
| 3,116,797 | 1/1964 | Launder | 172/484 |
| 3,461,971 | 8/1969 | Sprenkel | 172/484 |
| 3,503,456 | 3/1970 | Larson | 172/464 X |
| 3,527,308 | 9/1970 | Bernotas | 172/464 |
| 3,973,632 | 8/1976 | Torazzi | 172/474 |
| 4,013,129 | 3/1977 | Wilkinson | 172/484 |
| 4,321,970 | 3/1982 | Thigpen | 172/464 |
| 4,351,397 | 9/1982 | Winker | 172/464 |

*Primary Examiner*—Richard J. Johnson
*Attorney, Agent, or Firm*—Carl B. Fox, Jr.

[57] ABSTRACT

Ripper apparatus having interchangeable tool bar means whereby a tool bar having a single ripper blade may be used with the apparatus or a tool bar having plural ripper blades may be used with the apparatus, whereby the tool bar supporting elements may be used for the apparatus in either form.

7 Claims, 4 Drawing Figures

SIGNAL SHANK PARALLEL RIPPER APPARATUS

BACKGROUND OF THE DISCLOSURE

Ripper apparatuses are known having a single ripper blade or plural ripper blades. The apparatuses are usually mounted on a transporting vehicle such as a tractor, and heretofore to change from a single blade apparatus to a plural blade apparatus, or vise versa, it has been necessary to remove the complete single blade or plural blade apparatus from the vehicle and to attach a complete plural blade or single blade apparatus to the vehicle. This is usually a time consuming and thereby expensive procedure. It would be desirable to have available an apparatus which may be converted from single blade form to plural blade form, or vice versa, without removal and reinstallation of the complete apparatuses. In other words, it would be desirable to have an apparatus having parts which may be interchanged in order to convert from a single blade ripper apparatus to a plural blade ripper apparatus, or vice versa. This invention seeks to provide such a convertible apparatus.

SUMMARY OF THE INVENTION

The apparatus afforded by the invention includes support elements fixed to a movable vehicle, such as a tractor. These elements are adapted to support and operate plural tool bars, one of which may be adapted to receive a single ripper blade while another may be adaptable to receive plural ripper blades. The same support and operating elements are used in conjunction with each of the interchangeable tool bars. Therefore, if it is desired to change from use of a ripper having a single ripper blade to a ripper having plural ripper blades, or vice versa, all that needs be done is to substitute a different tool bar having a different number of ripper blade slots.

A principal object of the invention is to provide ripper apparatus having interchangeable tool bars whereby a single blade ripper apparatus may be converted to a plural blade ripper apparatus, or vise versa. Another object of the invention is to provide such apparatus through use of which the conversion time and effort to change between single blade and plural blade operation is reduced. Yet another object of the invention is to provide such an apparatus which is economical in that many of the elements of the apparatus are used in the alternate forms thereof. Another object of the invention is to provide such an apparatus which is simple, economical, and dependable and reliable in use.

Other objects and advantages of the invention will appear from the following detailed description of a preferred embodiment, reference being made to the accompanying drawings.

BRIEF DESCRIPTIONS OF THE DRAWINGS

DESCRIPTION OF THE PREFERRED EMBODIMENT

Figure 1:
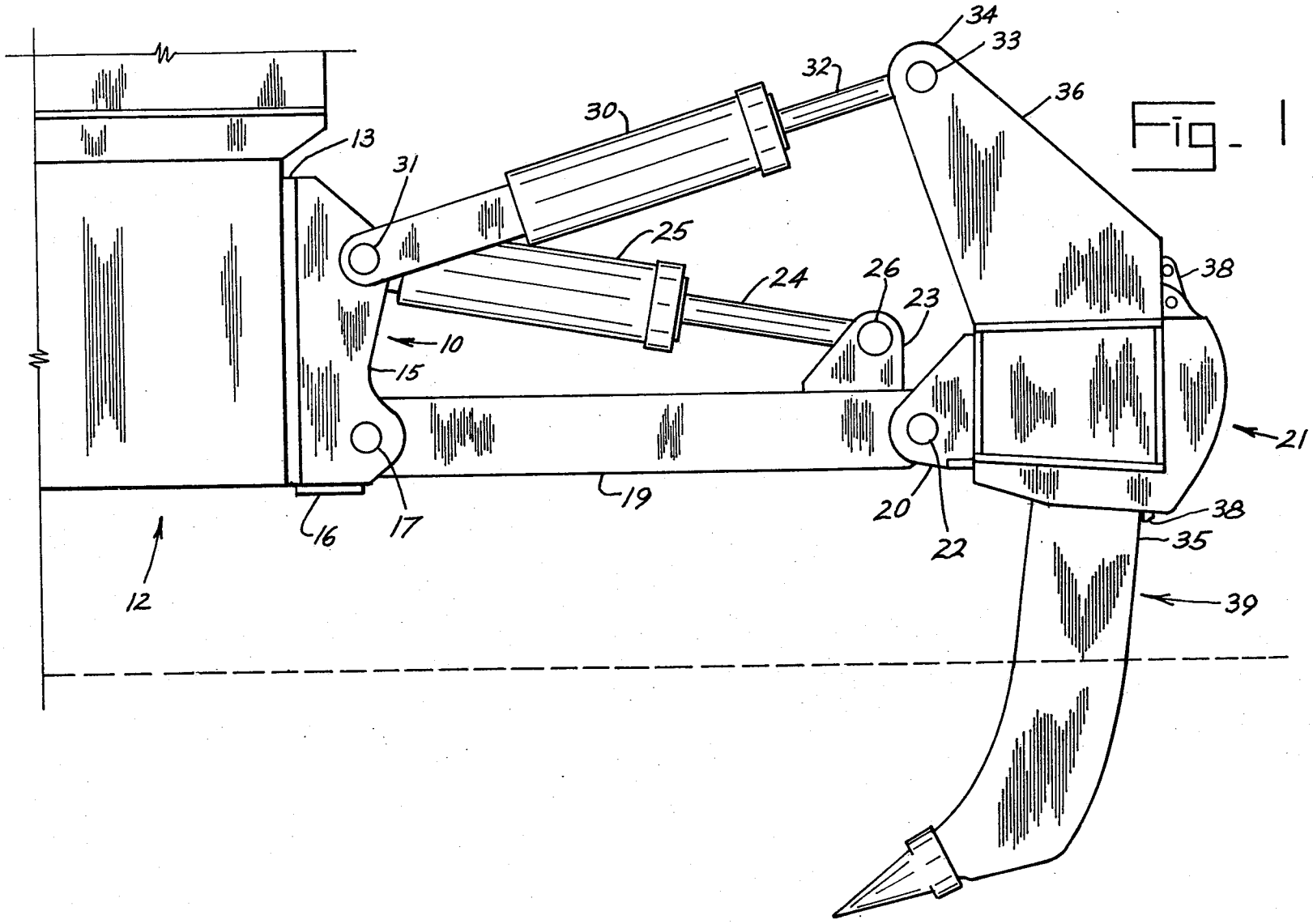
FIG. 1 is a side elevation of an apparatus of preferred form according to the invention, the righthand side of the drawing being the rearward end of the apparatus and the lefthand side of the drawing being the forward end of the apparatus, the apparatus being shown connected to a movable supporting vehicle.
Figure 2:
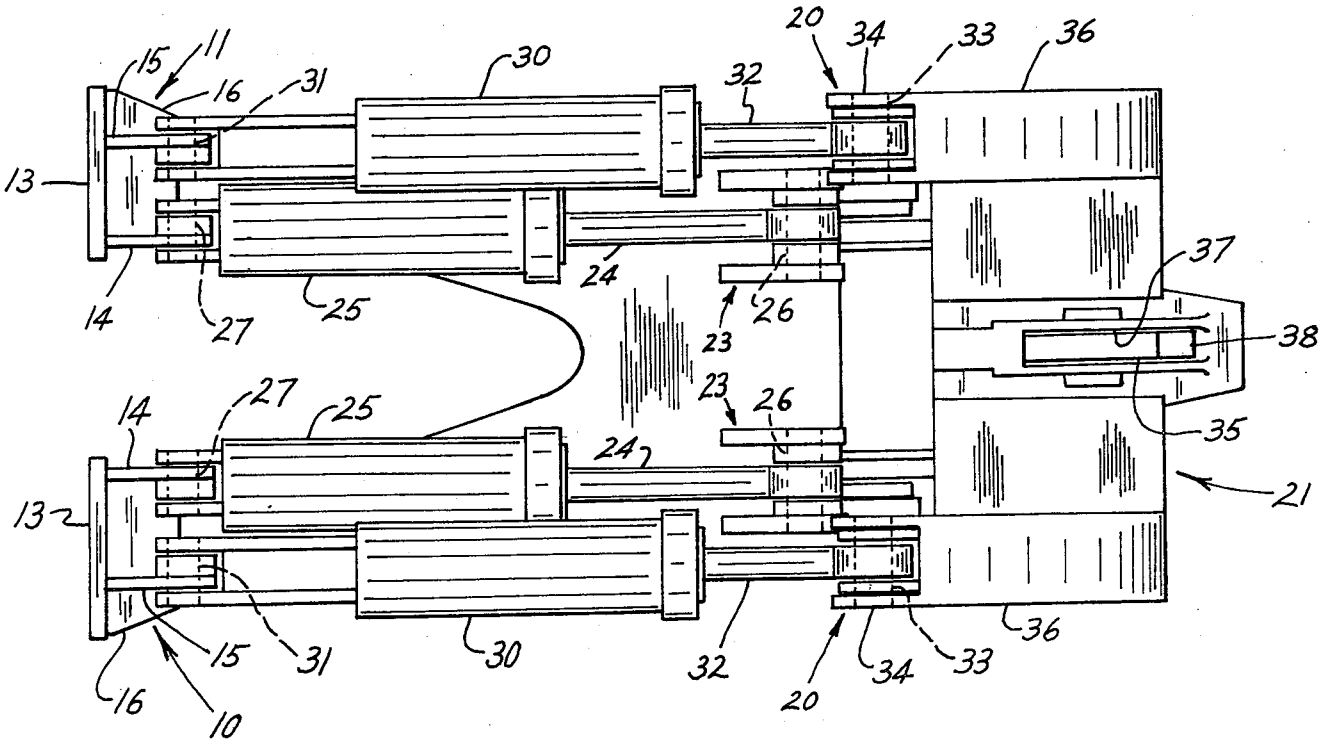
FIG. 2 is a top view of the apparatus shown in FIG. 1.

Referring first to FIGS. 1 and 2 of the drawings, the apparatus includes a pair of brackets 10, 11, which are of mirror image form, one with respect to the other. The brackets 10, 11 are affixed to the rear end of a movable support vehicle 12 only a portion of which is shown. Vehicle 12 may be a tractor, for example. Each bracket 10, 11 includes an upright plate 13 which is affixed to vehicle 12, a pair of yoke plates 14, 15 and a cross plate 16, which serves to reinforce the yoke plates 14, 15. A cross pin 17 disposed through suitable openings through the connected elements connects the lower end of each yoke plate 14 to one of a pair of draw bars 19, only one being shown, the other end of each draw bar 19 being connected by a pin 22 to a yoke 23 affixed to the forward side of a horizontally disposed transverse tool bar 21. Each draw bar 19 carries at its upper side toward its rearward end a yoke assembly 23 which is connected to shaft 24 of a lift cylinder 25 by a connecting pin 26 across the yoke 23. The other end of each cylinder 25 is connected to the upper end of one of the yoke plates 14 by a cross pin 27. A pair of shank adjustment cylinders 30, one at each side of the apparatus, each has its base end connected by a cross pin 31 to the upper end of a yoke plate 15, as shown. The shaft 32 of each cylinder 30 is connected by a cross pin 33 to a yoke 34 formed at the upper end of an angular arm 36 affixed at its lower end to the tool bar 21. It should be noted that the pins 27 and 31 are at a common axis, and in fact, the two pins may be replaced by a single longer pin, if desired.

Tool bar 21 is pivotal about the pins 22, and when the cylinders 30 are retracted the tool bar is pivoted upwardly about pins 22 and when cylinders 30 are extended the tool bar is pivoted downwardly about pins 22. The shank 35 of a ripper blade 39 is disposed through a slot 37 through the tool bar 21. A wear plate 38 is disposed between the front side of the tool bar shank and the rear end of slot 37, as disclosed in application Ser. No. 176,060, filed Aug. 7, 1980. It will be noted that the ripper blade slot 37 is disposed midway between the horizontal ends of the tool bar 21 so that the ripper blade is carried midway between the two pairs of cylinders 25 and 30.

Figure 4:
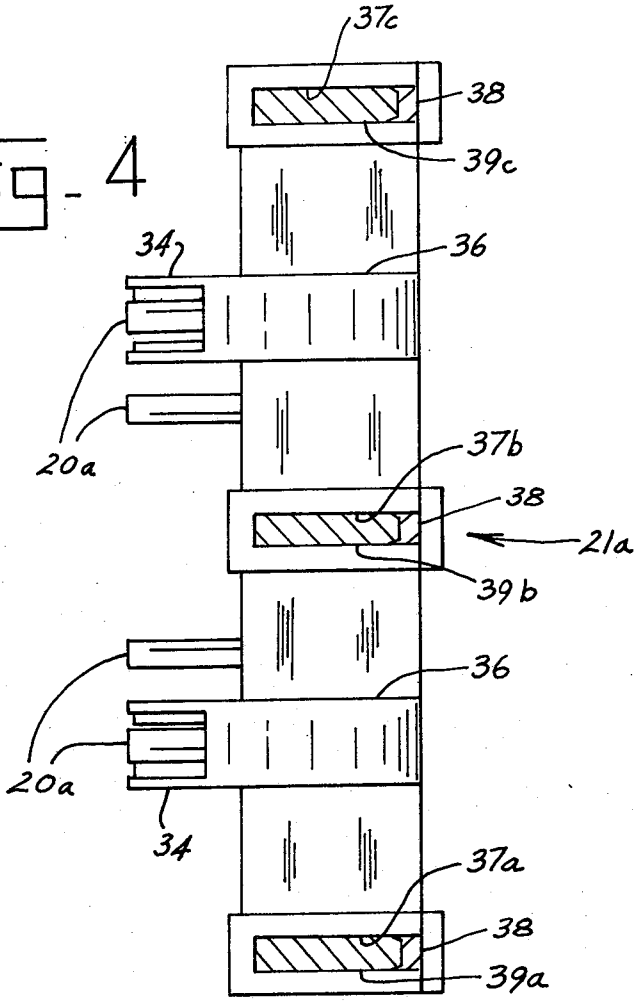
FIG. 4 is a top view of the apparatus shown in FIG. 3.
Figure 3:
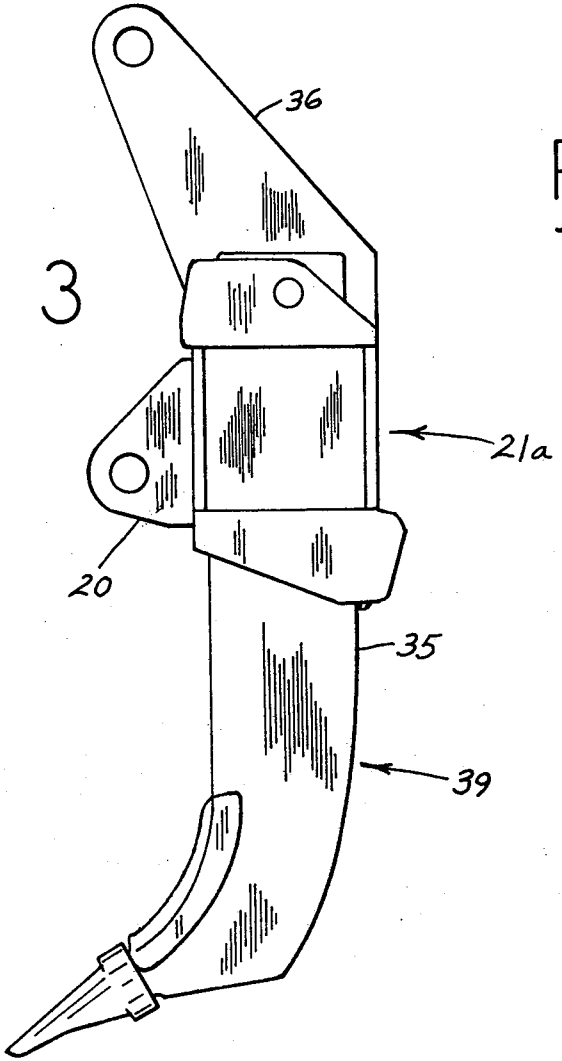
FIG. 3 is a partial side elevation showing a modified element of the apparatus of FIGS. 1 and 2.

The tool bar 21 shown in FIGS. 1 and 2, may be replaced by the tool bar **21*a* shown in FIGS. 3 and 4. Tool bar 21*a* has yokes 20*a* by which the drawbars 19 extending from brackets 10, 11 on the supporting vehicle may be connected by the cross pins 22. Tool bar 21*a* also has the arms 36 to which the cylinders 30 may be connected by pins 33 at yokes 34. Tool bar 21*a* has three transversely spaced slots 37*a*, 37*b*, 37*c* to receive the shanks 35 of three tool bars 39*a*, 39*b*, 39*c*, respectively. The ripper blades 39*a*, 39*b*, 39*c* are identical and interchangeable and are the same as the blade 39 of the FIG. 1—2 apparatus. It will be noted that tool bar 21*a* is connected to the supporting elements 10—33 in the same manner as the tool bar 21**. The tool bars are thereby interchangeable so that either may be used at the choice of the user. Therefore, the apparatus may be easily converted from a single ripper blade apparatus to a plural ripper blade apparatus having three ripper blades. Therefore, it is not necessary to have a complete plural ripper blade apparatus and a complete single blade apparatus, as only the tool bar portions need to be interchanged to convert from one to the other using the subject apparatus herein disclosed. The apparatus which has been described is very useful in that it may be used in place of complete single and multiple blade ripper apparatuses and is relatively economical as compared with the separate providing of each of these types of apparatuses.

It should be noted that pins 17, 31 are spaced apart a lesser distance than are pins 22, 33, so that elements 10, 21, 19, and 30 do not form a parallelogram as in many conventional ripper apparatuses. The parallelogram arrangement was believed to be advantageous for the reason that when the draw bar was raised or lowered, the blade angle with the ground remained unchanged. However, the parallelogram arrangement has a serious disadvantage which may not be readily perceived. When the draw bar is raised to raise the blade, the angle between the draw bar and the lower part of the blade is decreased, which can cause slab-like material being ripped to become clamped between the draw bar and the blade. Often, it is difficult to achieve release of the clamped material, so that the equipment becomes stuck and work cannot continue.

With pins 17, 31 closer together than pins 22, 33, as in the presently claimed apparatus, a lesser degree of decrease of the angle between the draw bar and blade occurs, so that there is less likelihood of material being clamped between the draw bar and the blade, and the likelihood of the equipment becoming stuck is correspondingly reduced. Since the draw bar to blade angle does not become small enough to create a clamping action upon raising of the draw bar and tool bar, the effect is that a releasing action is realized, so that no material becomes clamped between the drawbar and the blade when the blade is raised.

Since brackets 10, 11 are of lesser height than brackets for the parallelogram arrangement, and since only two sets of pin holes must be drilled in them, instead of the shree sets of holes for the parallelogram arrangement, cost of manufacture and weight of the equipment are both reduced.

So called radial ripper equipment, having no provision for blade angle adjustment, also does not create a material clamping action when the blade is raised, but such equipment is much harder to operate and optimum blade angle is rarely achieved since terrain does not have constant or predictable characteristics and blade angle is fixed.

According to the present invention, since material clamping does not occur, blade angle can be adjusted to the optimum angle and maintained, since alterations of the blade angle in attempts to release clamped material are not necessary.

While a preferred embodiment of apparatus according to the invention has been described and shown in the drawings, many modifications thereof may be made by a person skilled in the art without departing from the spirit of the invention, and it is intended to protect by Letters Patent all forms of the invention falling within the scope of the following claims.

I claim:

1. Ripper apparatus, comprising a pair of transversely spaced bracket means each having upper and lower connection means and each adapted to be fixed to a support vehicle, a pair of drawbars each pivotally connected to a said lower connection means of one of said bracket means and extending rearwardly therefrom and each having a tool bar connection means at its rearward end, a pair of first cylinder means each pivotally connected at one end to a said upper connection means of said bracket means and each pivotally connected at its other end to a yoke fixed to a said drawbar adjacent its rearward end, a pair of second cylinder means each pivotally connected at one end to a said upper connection of said bracket means and each pivotally connected at its other end to an upwardly extending arm of a transverse tool bar means, each of said upper connection means being disposed at the same vertical level, said tool bar means being pivotally connected to said tool bar connection means at the rearward ends of said drawbars, actuation of said first cylinder means causing pivotal movements of said drawbars about said lower connection means of said bracket means to raise or lower said tool bar means, and actuation of said second cylinder means causing pivotal movements of said tool bar means about its said pivotal connections to said rearward ends of said drawbars, said tool bar means comprising a pair of interchangeable tool bars, the first tool bar having a single blade slot for receiving the shank of a single ripper blade and the second tool bar having plural transversely spaced blade slots for receiving plural ripper blades, whereby connection of said first tool bar to said drawbars provides a ripper apparatus having a single ripper blade and connection of said second tool bar to said drawbars provides a ripper apparatus having plural ripper blades, whereby a single blade ripper apparatus may be readily converted to a plural blade ripper apparatus, and vice versa.

2. Ripper apparatus, comprising a pair of transversely spaced bracket means each having upper and lower connection means and each adapted to be fixed to a support vehicle, a pair of drawbars each pivotally connected to a said lower connection means of one of said bracket means and extending rearwardly therefrom and each having a tool bar connection means at its rearward end, a pair of first cylinder means each pivotally connected at one end to a said upper connection means of said bracket means and each pivotally connected at its other end to a yoke fixed to a said drawbar adjacent its rearward end, a pair of second cylinder means each pivotally connected at one end to a said upper connection of said bracket means and each pivotally connected at its other end to an upwardly extending arm of a transverse tool bar means, said pairs of first and second cylinder means being connected to each of said bracket means at said upper connection means thereof along a common pivotal axis, said tool bar means being pivotally connected to said tool bar connection means at the rearward ends of said drawbars, actuation of said first cylinder means causing pivotal movements of said drawbars about said lower connection means of said bracket means to raise or lower said tool bar means, and actuation of said second cylinder means causing pivotal movements of said tool bar means about its said pivotal connections to said rearward ends of said drawbars, said tool bar means comprising a pair of interchangeable tool bars, the first tool bar having a single blade slot for receiving the shank of a single ripper blade and the second tool bar having plural transversely spaced blade slots for receiving plural ripper blades, whereby connection of said first tool bar to said drawbars provides a ripper apparatus having a single ripper blade and connection of said second tool bar to said drawbars provides a ripper apparatus having plural ripper blades, whereby a single blade ripper apparatus may be readily converted to a plural blade ripper apparatus, and vice versa.

3. The combination of claim 2, each said blade slot and the ripper blade disposed therein being disposed vertically when said first or second tool bar is in a level untilted position.

4. The combination of claim 3, wherein each said bracket means has laterally spaced vertically disposed plates each of which has said lower and upper connection means, and wherein said pair of first cylinder means are connected to the relatively inward plates of each said bracket means and said pair of second cylinder means are connected to the relatively outward plate of each said bracket means.

5. The combination of claim 4, wherein each said blade slot has disposed therein a wear plate along its rearward side.

6. The combination of claim 5, wherein said pivotal connections of said drawbars to said tool bar are at the same elevation and wherein said pivotal connections of said second cylinder means to said yokes formed on said extending arms are at the same elevation.

7. The combination of claim 1, 2, 3, 4, 5, or 6, wherein said upper and lower connection means of said bracket means are spaced closer together than said tool bar connection means and said upwardly extending arm connections, said drawbars and said ripper blades not moving to a reduced angle therebetween capable of becoming clamped on ripped material, whereby said apparatus in use is not likely to become clamped on such ripped material.

* * * * *